United States Patent [19]

Anderton et al.

[11] 4,343,435

[45] Aug. 10, 1982

[54] FIRE HYDRANT DIFFUSER

[76] Inventors: Ronald V. Anderton, 5450 Balsam La., Plymouth, Minn. 55442; Donald S. Atwood, 11656 Mississippi Dr., Champlin, Minn. 55316

[21] Appl. No.: 206,478

[22] Filed: Nov. 13, 1980

[51] Int. Cl.[3] ..... B05B 1/26

[52] U.S. Cl. ..... 239/499; 239/504; 239/590.3

[58] Field of Search ..... 239/499–502, 239/504, 505, 509, 512, 518, 522, 524, 590, 590.3, 590.5

[56] References Cited

U.S. PATENT DOCUMENTS

| | | | |
|---|---|---|---|
| 2,900,139 | 8/1959 | Heusley | 239/499 |
| 3,074,727 | 1/1963 | Sosalla et al. | 239/590.5 |
| 3,305,140 | 8/1967 | Johnson | 222/193 |
| 3,419,082 | 12/1968 | O'Regan et al. | 239/504 X |
| 3,420,310 | 1/1969 | Mears et al. | 239/504 X |
| 3,603,512 | 9/1971 | Ham | 239/504 |
| 3,823,876 | 7/1974 | Hardy et al. | 239/504 |
| 4,047,668 | 9/1977 | DeWeese et al. | 239/500 |

FOREIGN PATENT DOCUMENTS

| | | | |
|---|---|---|---|
| 201225 | 2/1956 | Australia | 239/502 |
| 339316 | 6/1972 | U.S.S.R. | 239/502 |

*Primary Examiner*—Johnny D. Cherry
*Attorney, Agent, or Firm*—Leo Gregory

[57] ABSTRACT

A fire hydrant diffuser comprising a flared housing rectangular in cross section having disposed therein a pair of water diffusing members in opposed relation angled to form a V-configuration and having a stepped mesh structure positioned relative to the direction of flow of water to present narrow obstructing slits for the passage of the water.

5 Claims, 5 Drawing Figures

FIRE HYDRANT DIFFUSER

BACKGROUND OF THE INVENTION

1. Field of the Invention

This invention relates to a fire hydrant diffuser.

2. Description of the Prior Art

Known art relative to a fire hydrant diffuser is the disclosure of U.S. Pat. No. 4,047,668 which comprises a substantially frusto-conical housing having a plurality of screen members or diffuser elements spaced in parallel relation and disposed in planes at right angles to the axis of said housing.

SUMMARY OF THE INVENTION

It is desirable and an object of this invention to provide a fire hydrant diffuser which very effectively interrupts a high pressure stream of water reducing it to a flow such as for cleaning out water lines or for street washing purposes, such reduced flow having no damaging effect.

It is another object of this invention to provide a hydrant diffuser which will not become clogged and which will be maintenance free.

It is a further object of the invention to provide a fire hydrant diffuser comprising a pair of diffusing elements of relatively wide mesh and being angled to the direction of the flow of the stream through the housing of the diffuser to in effect present narrow vertically walled obstructing slits through which the water passes.

More specifically, it is the object of this invention to provide a fire hydrant diffuser having a flared body portion substantially rectangular in cross section having therein a pair of opposed filter elements carried by their respective adjacent walls of said housing and being angled to form a V-configuration, the mesh formation of said elements having wall surfaces disposed to be perpendicular to the direction of the flow of water therethrough and in effect such elements being angled to present narrow obstructing slit openings to the passage of water, said mesh being arranged to have a progressive stepped relationship.

These and other objects and advantages of the invention will be set forth in the following description made in connection with the accompanying drawings in which like reference characters refer to similar part throughout the several views.

DESCRIPTION OF A PREFERRED EMBODIMENT

Figure 1:
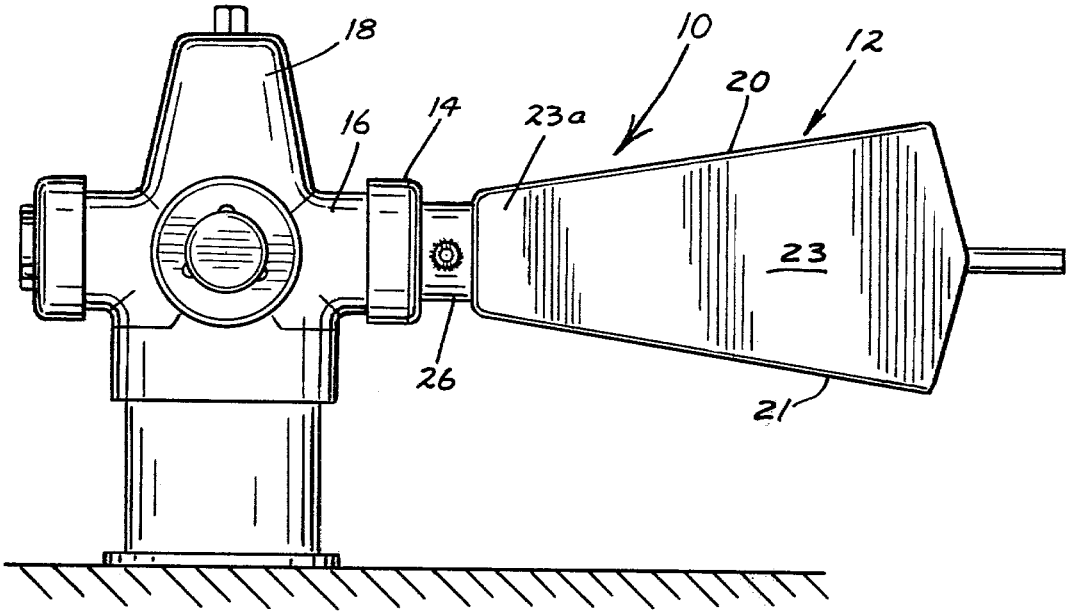
FIG. 1 is a view in side elevation.

Referring to the drawings, the fire hydrant diffuser, the subject matter of the invention herein, is indicated generally by the reference numeral 10 and comprises a housing indicated generally by 12 having a female fitting 14 to be threaded onto the male outlet 16 of a common type of a fire hydrant 18.

Said housing 12 is here shown to be substantially rectangular in cross section and to flare outwardly from its inlet end portion 14.

Said housing comprises walls 20, 21, 22 and 23, said walls flaring outwardly from their lower end portions such as at 20*a* and 23*a* in the direction of their outer end portions such as at 20*b*. A neck or connective portion 26 extends from said housing to be integral with the fitting 14. Extending outwardly of either side of said neck portion 26 are handle portions 28 and 30.

Said walls 22 and 23 have outwardly angled end portions as at 22*c* and extending therebetween is a frame member 32 in the form of a pipe welded therebetween and having a pipe-like handle member 33 extending outwardly thereof.

Formed within said housing is a chamber 35 and disposed therein secured to the walls 22 and 23 is a diffuser member indicated generally by the reference numeral 38.

Said diffuser member 38 as here shown comprises a pair of diffusing screen members 40 and 41 in opposed relation and which are angled inwardly rearwardly relative to their respective adjacent overlying walls 20 and 21 and which converge to engage and be secured as by welding as at 43, thus forming a V-configuration in longitudinal cross section. Said screen members extend laterally to engage and be secured as by welding to the walls 22 and 23. Said point of converging of said screen members is spaced inwardly of the inlet 48 to said housing 12.

The screen member 40 will be described as representative of the screen member 41.

Said screen member 40 is formed comprising an expanded mesh having openings S, the mesh being of narrow plate like or wall construction forming baffles such as indicated at B.

Figure 2:
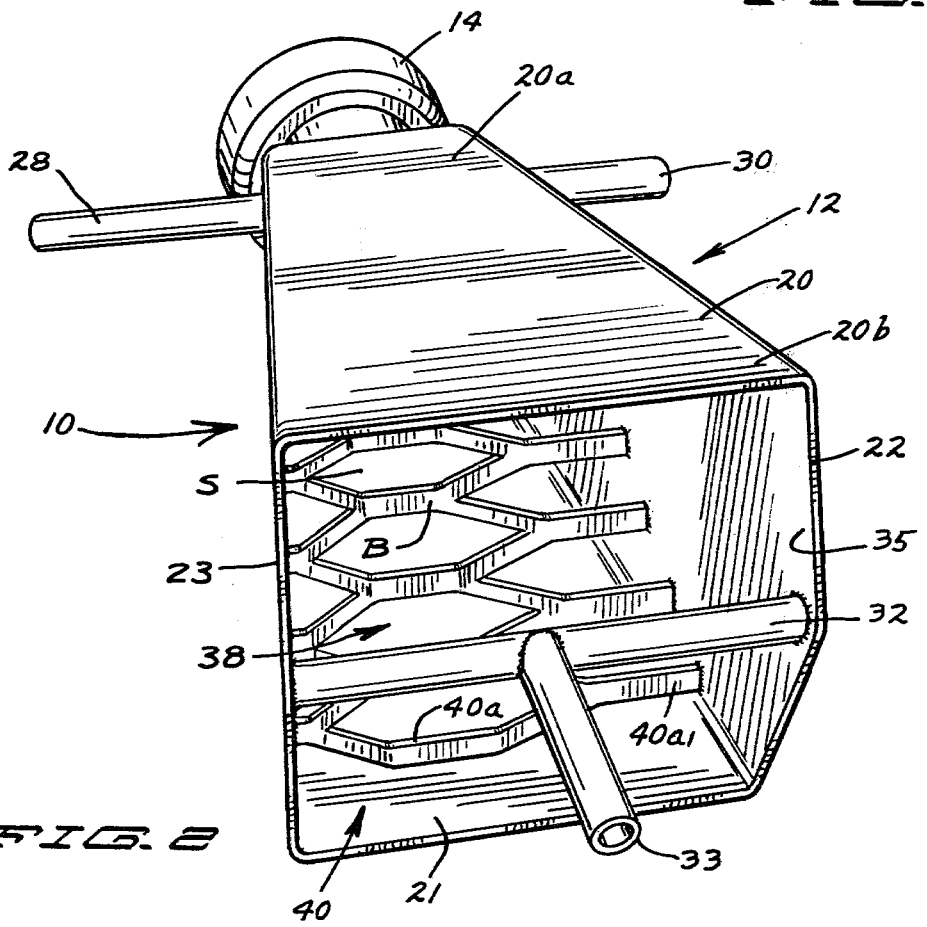
FIG. 2 is a view in perspective.
Figure 3:
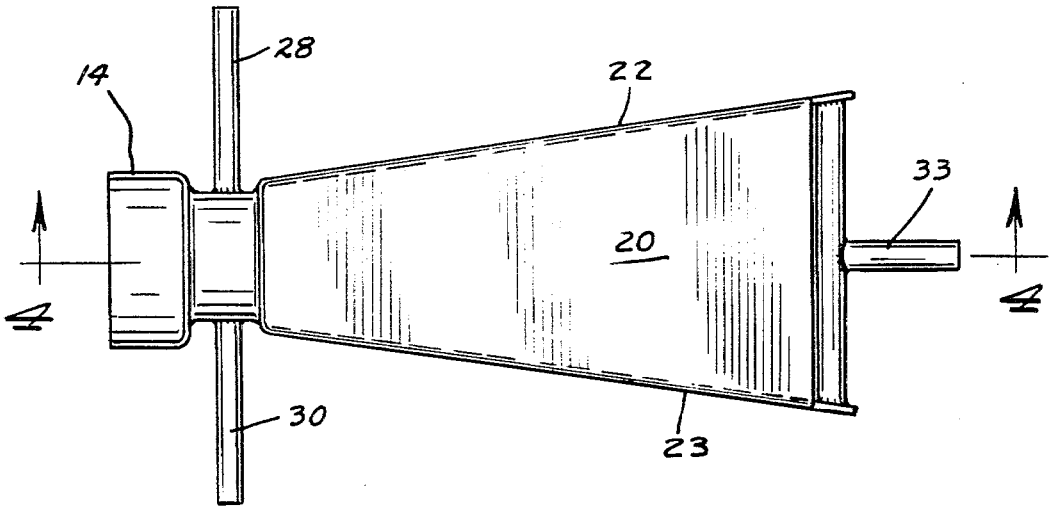
FIG. 3 is a top plan view.
Figure 4:
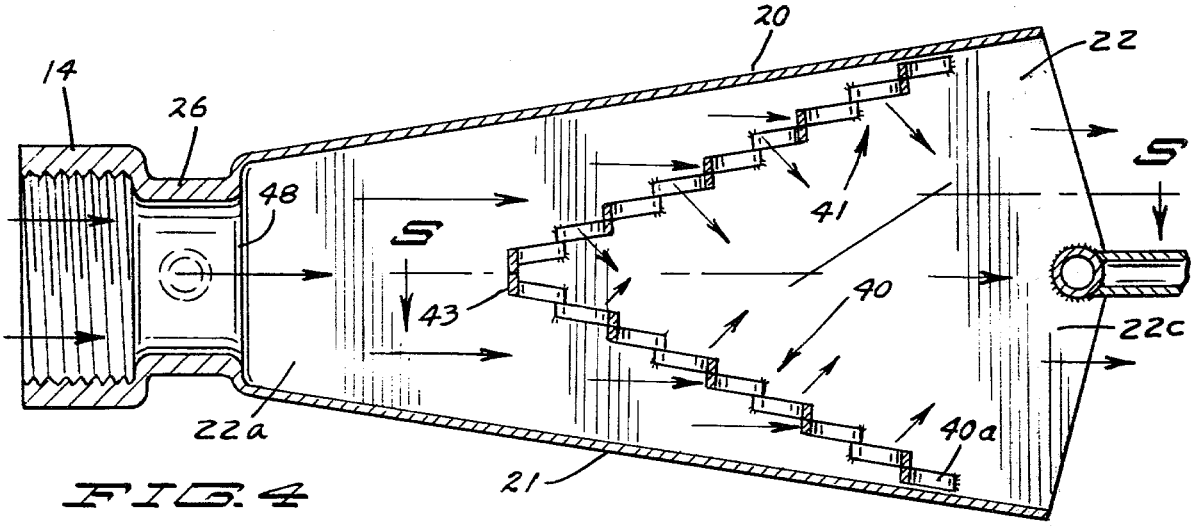
FIG. 4 is a view in horizontal section taken on line 4—4 of FIG. 3 as indicated.
Figure 5:
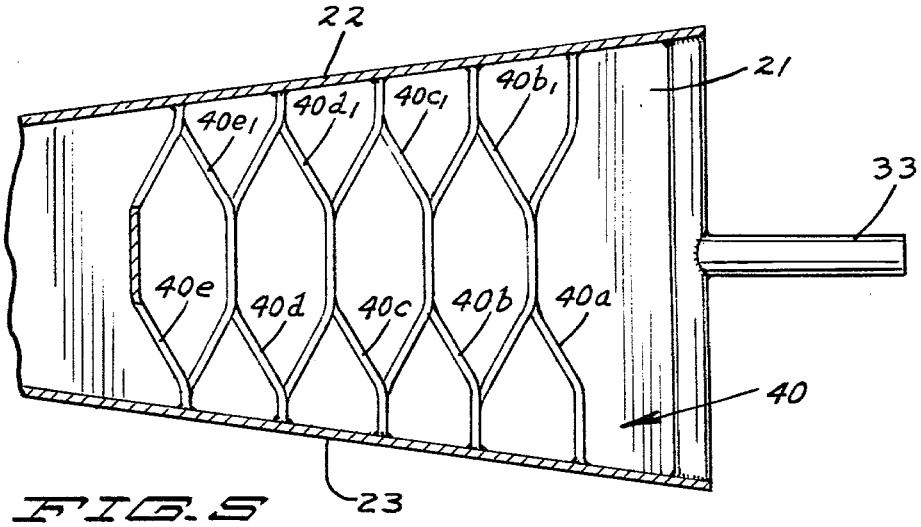
FIG. 5 is a fragmentary view in horizontal section taken on line 5—5 of FIG. 4 as indicated.

The mesh construction consists of a plurality of centrally offset or angled plate or wall like members 40*a*–40*e* having lateral extensions at each side thereof as at 40*al* in FIG. 2 to engage the walls 22 and 23 and be welded thereto. The mesh members 40*a*–40*e* are interconnected as by welding by and with the offset or angled plate or wall members 40*bl*–40*el*. Thus is formed the integral screen member 40 in the embodiment here presented.

Further, in connection with the mesh construction of the screen members as above described, the screen members are angled to have the walls as at B of the mesh construction disposed to be substantially at right angles to the axis of said housing 12 and to the direction of the flow of water through the housing. Further, the mesh members 40*a*–40*e* and 40*bl*–40*el* are respectively progressively vertically stepped in the direction of the corresponding stepped mesh members of the opposing screen member 41.

Viewing the screen members 40 and 41 through the coupling 14 from the point of convergance in the direction of the outlet end of said housing 12, it would be seen that as a result of the progressive stepped construction of the mesh of said screen members and as a result of the angled disposition of the screen members that the spaces S formed in the mesh become in effect elongated obstructing slits and thus present a very effective baffle surfaced to obstruct the flow of the water and to very effectively blunt the thrust of the water and cause a non-damaging dispersion of the water to come out of the housing.

The housing 14 in flaring in the direction of its outlet end provides an expanding chamber 35 which also tends to reduce the velocity of the water flow therethrough.

The operation of the device would appear to be clear from the description. A very common purpose for the use of the hydrant diffuser is for the purpose of periodically draining water lines. This device has proved to be very satisfactory.

It will of course be understood that various changes may be made in form, details, arrangement and proportions of the parts without departing from the scope of the invention herein which, generally stated, consists in a device capable of carrying out the objects above set forth, in the parts and combinations of parts disclosed and defined in the appended claims.

What is claimed is:

1. A fire hydrant diffuser comprising a housing having an inlet and an outlet;

said housing flaring in the direction of said outlet;

a pair of screen members being disposed within said housing in opposed relation extending transversely of said housing and being secured thereto;

said screen members being angled relative to each other and coverging at a point spaced from said inlet;

said screen members being formed as an expanded mesh;

the openings of said mesh being defined by interconnected wall portions of said screen members;

corresponding wall portions of said screen members being disposed in planes at right angles to the direction of water passing through said housing and corresponding of successive of said wall portions in the direction of the outlet of said housing being in outward stepped relation and said openings formed by said wall portions being disposed in a corresponding stepped relation whereby, said wall portions form vertical barriers receiving directly the thrust of water passing through said housing blunting said thrust prior to the passage of said water through said openings.

2. The structure set forth in claim 1, wherein said housing is substantially rectangular in cross section having pairs of opposed walls.

3. The structure of claim 2, wherein said screen members are secured to a pair of opposed walls.

4. The structure set forth in claim 2, wherein said pairs of opposed walls flaring in the direction of said outlet of said housing.

5. The structure set forth in claim 1, wherein said openings formed in said screen members are disposed to be in planes lying substantially in the direction of the passage of water through said housing.

* * * * *